US008087808B2

(12) United States Patent
Hu

(10) Patent No.: US 8,087,808 B2
(45) Date of Patent: Jan. 3, 2012

(54) FLASHLIGHT WITH A HEAT SINK

(76) Inventor: Yung-Ching Hu, Zhubei (TW)

( * ) Notice: Subject to any disclaimer, the term of this patent is extended or adjusted under 35 U.S.C. 154(b) by 116 days.

(21) Appl. No.: 12/633,600

(22) Filed: Dec. 8, 2009

(65) Prior Publication Data

US 2011/0134632 A1 Jun. 9, 2011

(51) Int. Cl.
*F21V 29/00* (2006.01)

(52) U.S. Cl. ..... 362/373; 362/218; 362/202; 362/800

(58) Field of Classification Search ..... 362/202, 362/373, 294, 208, 800; 165/80.3, 185; 174/16.3; 257/712, 706; 313/512
See application file for complete search history.

(56) References Cited

U.S. PATENT DOCUMENTS 2,928,934 A * 3/1960 Atkin ..... 362/382
5,223,747 A * 6/1993 Tschulena ..... 257/713
5,634,711 A * 6/1997 Kennedy et al. ..... 362/119
6,966,677 B2 * 11/2005 Galli ..... 362/373
7,674,003 B2 * 3/2010 Sharrah et al. ..... 362/205
7,726,844 B2 * 6/2010 Chen ..... 362/294
7,758,205 B2 * 7/2010 Liu ..... 362/202

* cited by examiner

*Primary Examiner* — Ali Alavi
(74) *Attorney, Agent, or Firm* — Hershkovitz & Associates, LLC; Abraham Hershkovitz

(57) ABSTRACT

A flashlight has a handle assembly and a lens cover. The handle assembly has a housing, a heat sink and en electrical unit. The housing has a front end. The heat sink is mounted in the housing and has a front end and a rear end. The electrical unit is mounted in the housing and detachably mounted on the rear end of the heat sink. The lens cover is securely mounted on the front end of the housing and has an LED element mounted securely on the heat sink. The lens cover has an LED electrically connected with the electrical unit with wires. Because the LED element and the electrical unit are separated by the heat sink, heat generated from the LED can be dissipated though the heat sink, instead of being directly conducted to the electrical unit and damaging the electrical unit.

4 Claims, 5 Drawing Sheets

FLASHLIGHT WITH A HEAT SINK

BACKGROUND OF THE INVENTION

1. Field of the Invention

The present invention relates to a flashlight, and more particularly to a flashlight with a heat sink.

2. Description of Related Art

With reference to FIG. 5, a conventional flashlight comprises a lens cover (30) and a handle assembly (40).

The lens cover (30) has a lighting element (31) mounted in the lens cover (30). The lighting element (31) has a conductive head (311), an LED (312) and a circuit board (313). The conductive head (311) has two ends. The LED (312) and the circuit board (313) are respectively mounted on the ends of the conductive head (311) and connected electrically with each other via the conductive head (311) to form a circuit loop.

However, the LED (312) generates heat during the use of the flashlight and will overheat after long time of use. Additionally, the heat will be conducted to the circuit board (313) through the conductive head (311), so the circuit board (313) will be damaged and useful life of the flashlight will be decreased.

To overcome the shortcomings, the present invention tends to provide a flashlight with a heat sink to militate the aforementioned problems.

SUMMARY OF THE INVENTION

The main objective of the invention is to provide a flashlight with a heat sink. The flashlight prevents heat from being directly conducted to the electrical unit and has excellent heat dissipation.

A flashlight has a handle assembly and a lens cover. The handle assembly has a housing, a heat sink and an electrical unit. The housing has a front end. The heat sink is mounted in the housing and has a front end and a rear end. The electrical unit is mounted in the housing and detachably mounted on the rear end of the heat sink. The lens cover is securely mounted on the front end of the housing and has an LED element mounted securely on the heat sink. The lens cover has an LED electrically connected with the electrical unit with wires. Because the LED element and the electrical unit are separated by the heat sink, heat generated from the LED can be dissipated though the heat sink, instead of being directly conducted to the electrical unit and damaging the electrical unit.

Other objects, advantages and novel features of the invention will become more apparent from the following detailed description when taken in conjunction with the accompanying drawings.

DETAILED DESCRIPTION OF PREFERRED EMBODIMENT

Figure 1:
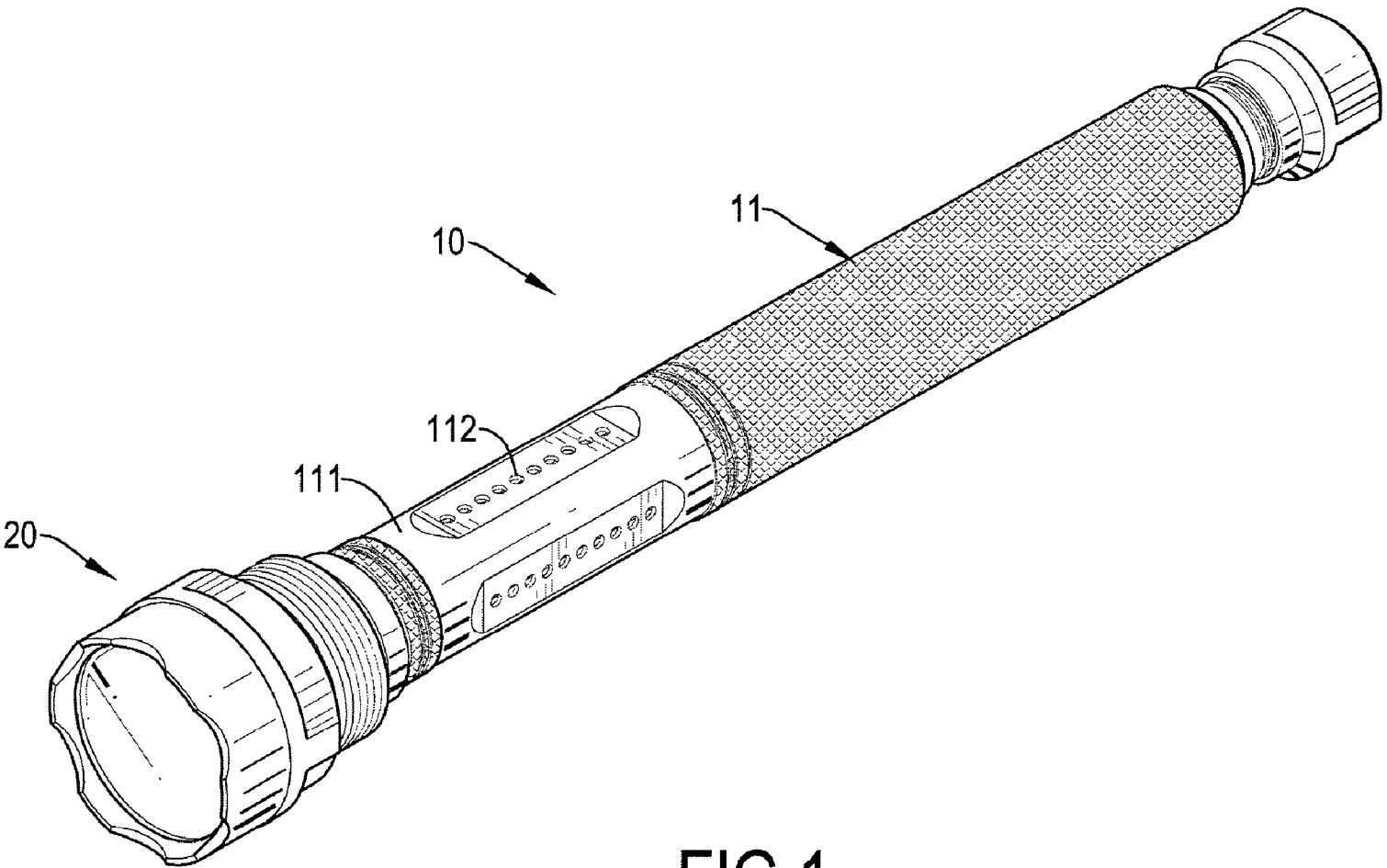
FIG. 1 is a perspective view of a flashlight in accordance with the present invention.
Figure 2:
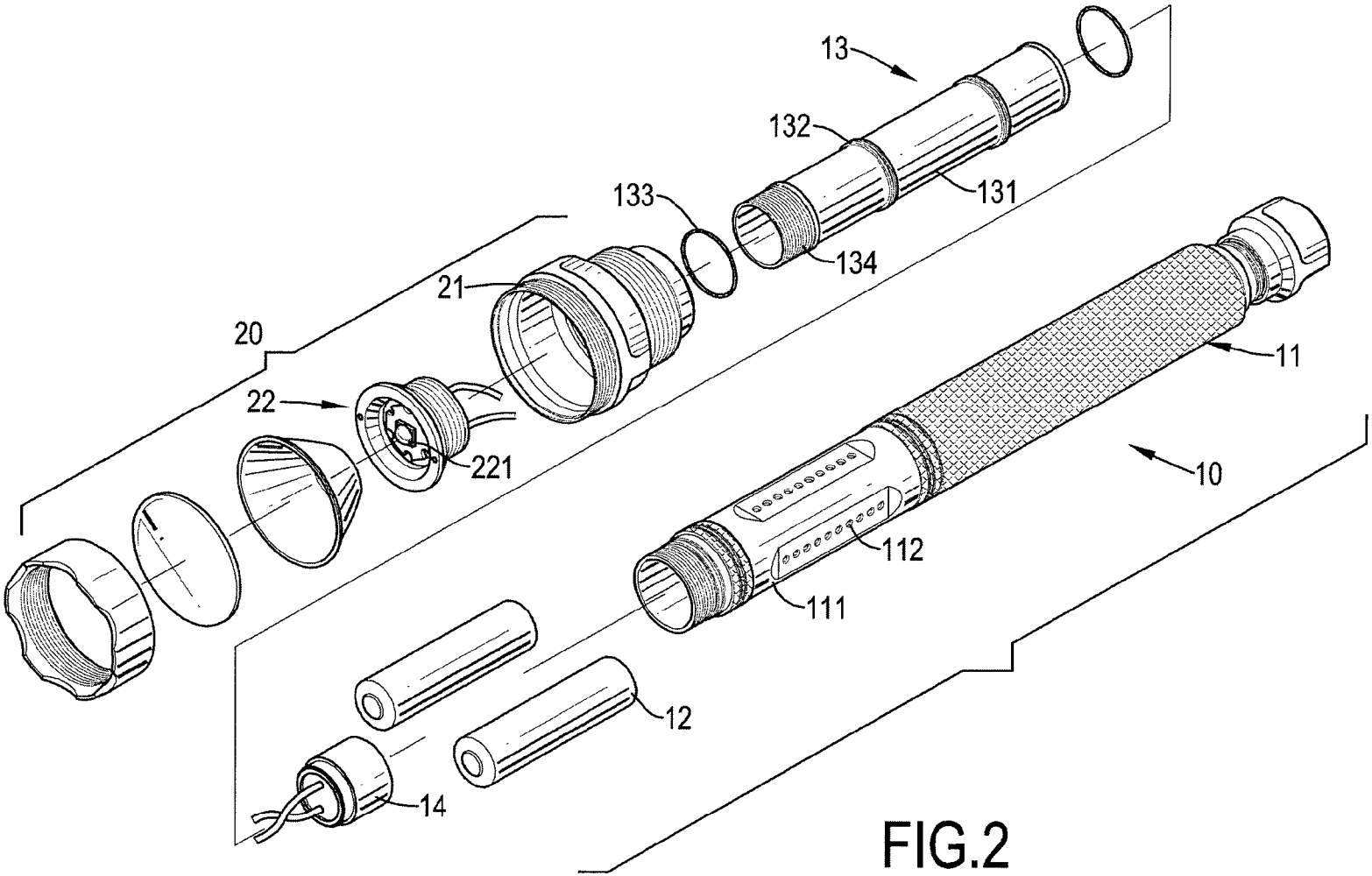
FIG. 2 is an exploded perspective view of the flashlight in FIG. 1.
Figure 3:
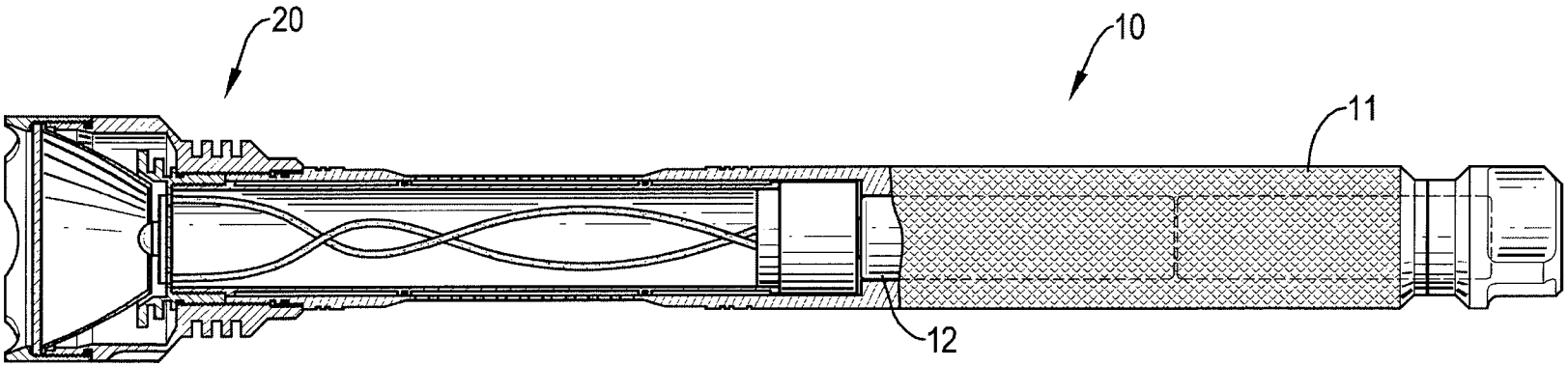
FIG. 3 is a side view in partial section of the flashlight in FIG. 1.

With reference to FIGS. 1 to 3, a flashlight comprises a handle assembly (10) and a lens cover (20).

The handle assembly (10) has a housing (11), two batteries (12), a heat sink (13) and an electrical unit (14). The housing (11) is tubular and has a front end, a rear end, an outer surface, an inner surface, a dissipating section (111) and multiple vents (112). The dissipating section (111) is defined around the outer surface near the front end of the housing (11) and has a front segment and a rear segment. The vents (112) are defined though the dissipating section (111).

The batteries (12) are mounted in the housing (11) near the rear end of the housing (11).

Figure 4:
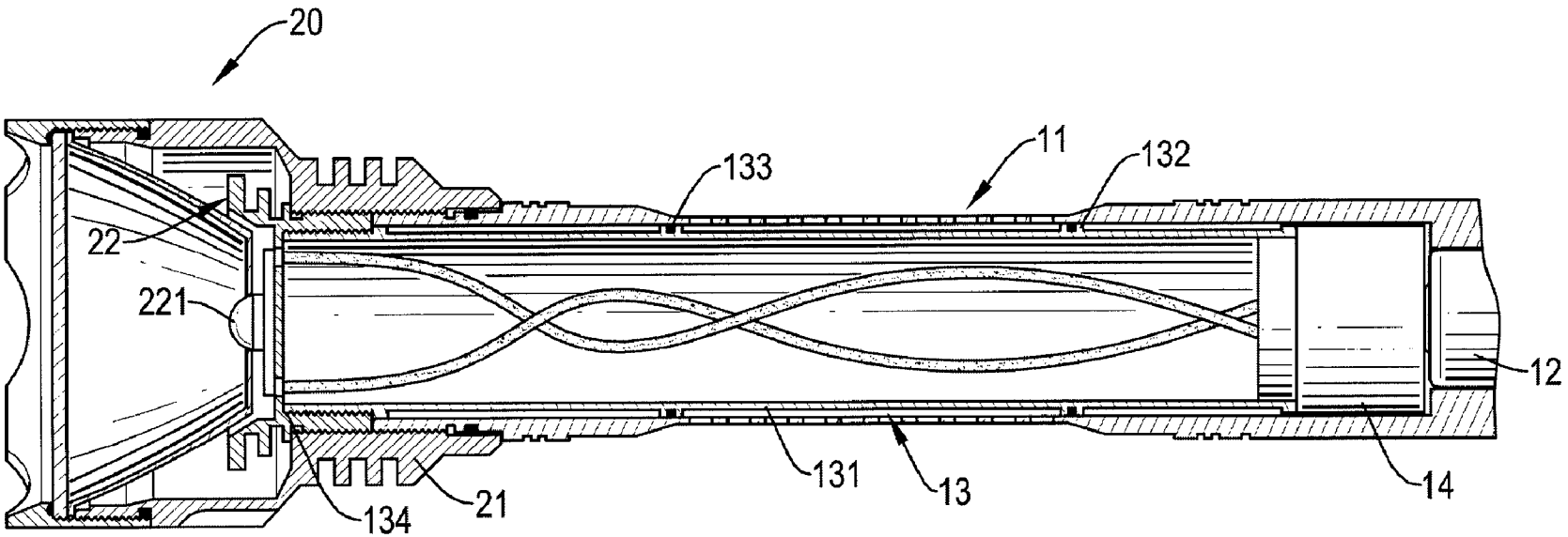
FIG. 4 is an enlarged side view in partial section of the flashlight in FIG. 3.
Figure 5:
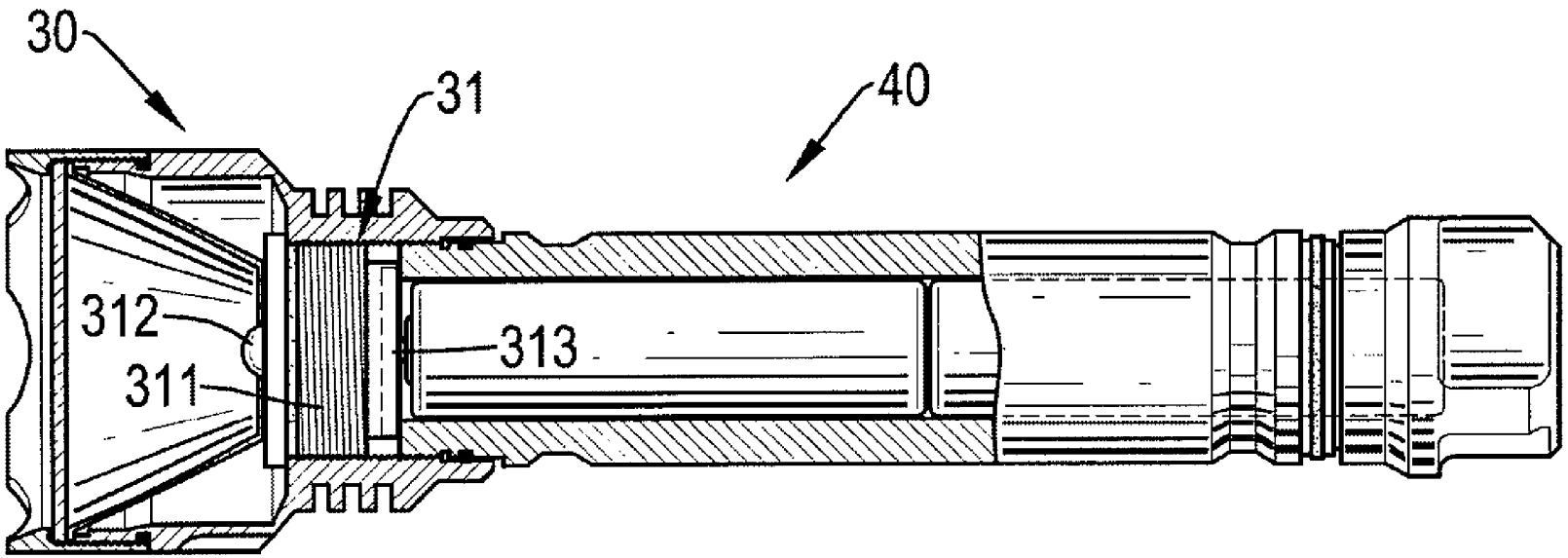
FIG.5 PRIOR ART
FIG. 5 is a side view in partial section of a conventional flashlight in accordance with the prior art.

With further reference to FIG. 4, the heat sink (13) is mounted in the housing (11) at a location corresponding to the dissipating section (111). Preferably, the heat sink (13) has a tube (131), two flanges (132), two O-rings (133) and a connecting section (134).

The tube (131) has an outer surface, a front end and a rear end. The flanges (132) are annular, protrude from the outer surface of the tube (131), abut the inner surface of the housing (11) and are respectively near the front segment and the rear segment of the dissipating section (111). The O-rings (133) are respectively mounted around the flanges (132) and abut the inner surface of the housing (11).

The connecting section (134) is defined around the front end of the tube (131) and may be threaded.

The heat sink (13) may be an aluminum tube or have multiple fins. The present invention does not limit the format and material of the heat sink (13).

The electrical unit (14) is detachably mounted on the rear end of the tube (131) and has a circuit board. The circuit board is electrically connected with the batteries (12).

The lens cover (20) is securely mounted on the front end of the housing (11) and has a shell (21) and an LED element (22). The shell (21) is screwed on the front end of the housing (11). The LED element (22) is mounted in the shell (21), is screwed on the connecting section (134) and has an LED (221). The LED (221) is electrically connected with the electrical unit (14) with wires.

From the above description, it is noted that the present invention has the following advantages:

1. Prevention of heat from being directly conducted to the electrical unit (14):

Because the LED element (22) and the electrical unit (14) are separated by the heat sink (13), heat generated from the LED (221) can be dissipated though the heat sink (13), instead of being directly conducted to the electrical unit (14). Accordingly, the circuit board of the electrical unit (14) can be kept from being damaged.

2. Excellent heat dissipation:

With the tubular heat sink (13), the heat dissipating area becomes larger to speed up the heat dissipation. Moreover, the vents (112) facilitate hot air in the tube (131) to escape. Therefore, excellent heat dissipation is achieved.

3. Effective separation from moisture:

Because the flanges (132) and the O-rings (133) abut the inner surface of the housing (11), moisture can be kept from entering the housing (11) and the batteries (12) will not be damaged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flashlight comprising:

a handle assembly having a housing having a front end;

an inner surface;

an outer surface;

a dissipating section defined around the outer surface near the front end of the housing and having a front segment; and a rear segment; and multiple vents defined through the dissipating section, each vent having a cross section less than one twentieth of an outer surface measure of the dissipating section;

a heat sink mounted in the housing and having a front end;

a rear end;

a connecting section defined around the front end of the heat sink;

a tube having a front end, a rear end and an outer surface;

two flanges protruding from the outer surface of the tube, abutting the inner surface of the housing and respectively near the front segment and the rear segment of the dissipating section; and two O-rings respectively mounted around the flanges and abutting the inner surface of the housing; and an electrical unit mounted in the housing and detachably mounted on the rear end of the heat sink; and a lens cover securely mounted on the front end of the housing and having a shell mounted securely on the front end of the housing; and an LED element mounted in the shell and mounted securely on the connecting section and having an LED electrically connected with the electrical unit with wires.

2. The flashlight as claimed in claim 1, wherein the housing has a rear end;

the handle assembly has two batteries mounted in the housing near the rear end of the housing;

the connecting section is defined around the front end of the tube; and the electrical unit is detachably mounted on the rear end of the tube and is electrically connected with the batteries.

3. The flashlight as claimed in claim 2, wherein the LED element is screwed on the connecting section of the heat sink and has an LED.

4. The flashlight as claimed in claim 1, wherein the LED element is screwed on the connecting section of the heat sink and has an LED.

* * * * *